US005356025A

United States Patent [19]

Renault

[11] Patent Number: 5,356,025

[45] Date of Patent: Oct. 18, 1994

[54] PACKAGING DEVICE FOR COSMETIC PRODUCTS

[75] Inventor: Philippe Renault, Paris, France

[73] Assignee: L'Oreal, Paris, France

[21] Appl. No.: 42,523

[22] Filed: Apr. 5, 1993

[30] Foreign Application Priority Data

Apr. 3, 1992 [FR] France ..... 92 04095

[51] Int. Cl.[5] ..... B65D 43/16

[52] U.S. Cl. ..... 220/263; 220/260; 220/329; 220/334; 220/338; 206/581; 132/293; 132/315

[58] Field of Search ..... 220/262, 263, 264, 260, 220/329, 331, 334, 338, 340; 215/303; 206/581; 132/293, 295, 300, 301, 304, 305, 315

[56] References Cited

U.S. PATENT DOCUMENTS

| | | | |
|---|---|---|---|
| 2,062,967 | 12/1936 | Canepa | 220/263 |
| 2,155,797 | 4/1939 | Mitchell | 132/293 |
| 2,307,648 | 1/1943 | Tremolieres | 132/293 X |
| 2,397,478 | 4/1946 | Drechsler et al. | 220/263 X |
| 2,446,080 | 7/1948 | Dennis | 132/293 |
| 2,562,580 | 7/1951 | Satz et al. . | |
| 3,308,835 | 3/1967 | Silverberg . | |
| 3,476,123 | 11/1969 | Flax | 132/315 |
| 3,552,402 | 1/1971 | Levy | 132/293 |
| 3,982,651 | 9/1976 | Braun et al. | 220/260 X |
| 3,995,764 | 12/1976 | Zagami | 220/263 |
| 5,025,817 | 6/1991 | Wen | 132/296 |
| 5,205,402 | 4/1993 | Maeda | 206/250 |

FOREIGN PATENT DOCUMENTS

| | | |
|---|---|---|
| 228115 | 12/1909 | Fed. Rep. of Germany . |
| 592489 | 1/1934 | Fed. Rep. of Germany . |
| 2655248 | 12/1989 | France . |

*Primary Examiner*—Allan N. Shoap
*Assistant Examiner*—Vanessa Caretto
*Attorney, Agent, or Firm*—Oliff & Berridge

[57] ABSTRACT

A packaging device for cosmetics includes a body defining a chamber with a lid articulated thereto. The packaging device has an operating element rotatably mounted on the body which has an inclined ramp. The lid has, in the vicinity of its articulation on the body, a tongue which engages a vertical guide provided in a wall of the body. The tongue is slidably attached to the ramp and moves in a vertical direction as the operating element is rotated. The rotational movement of the operating element relative to the body and to the tongue provides for a guided translational movement of the tongue along the wall of the body and the tilting of the lid around its articulation axis on the body.

22 Claims, 2 Drawing Sheets

FIG.3
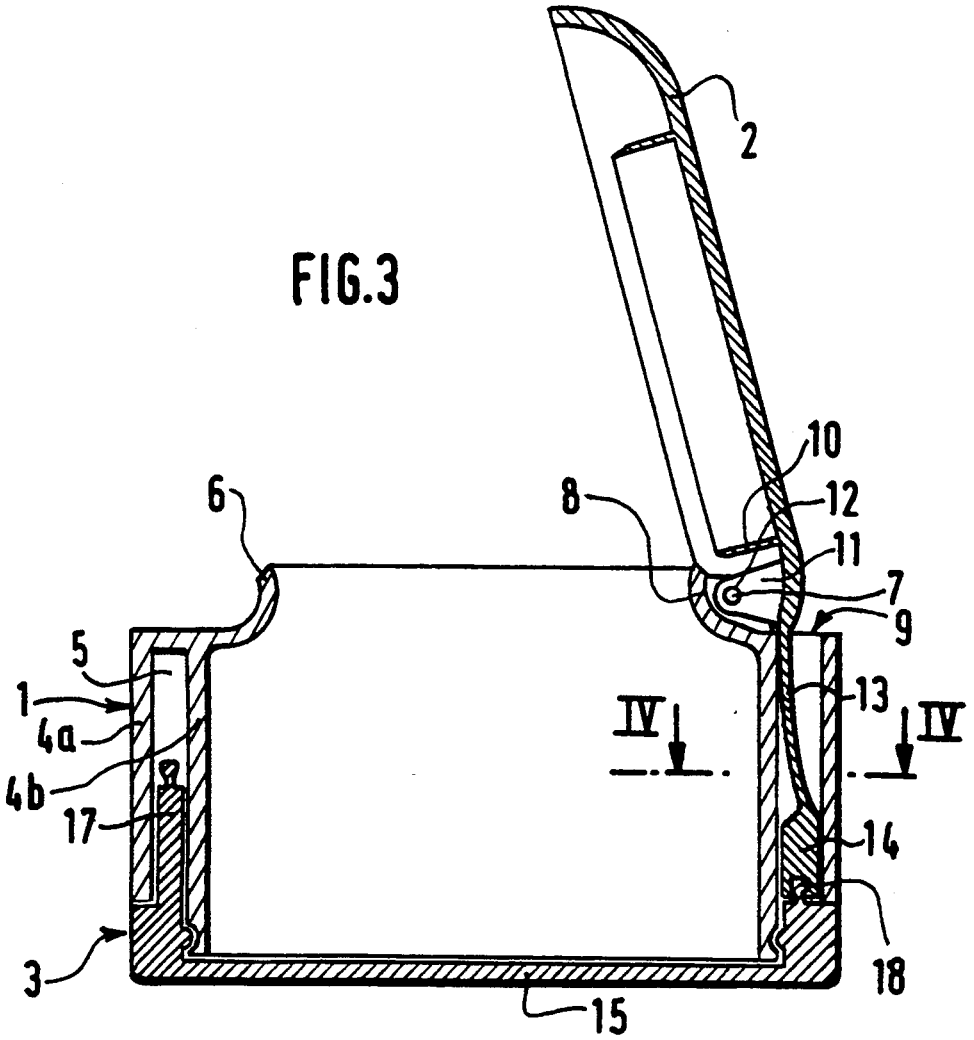
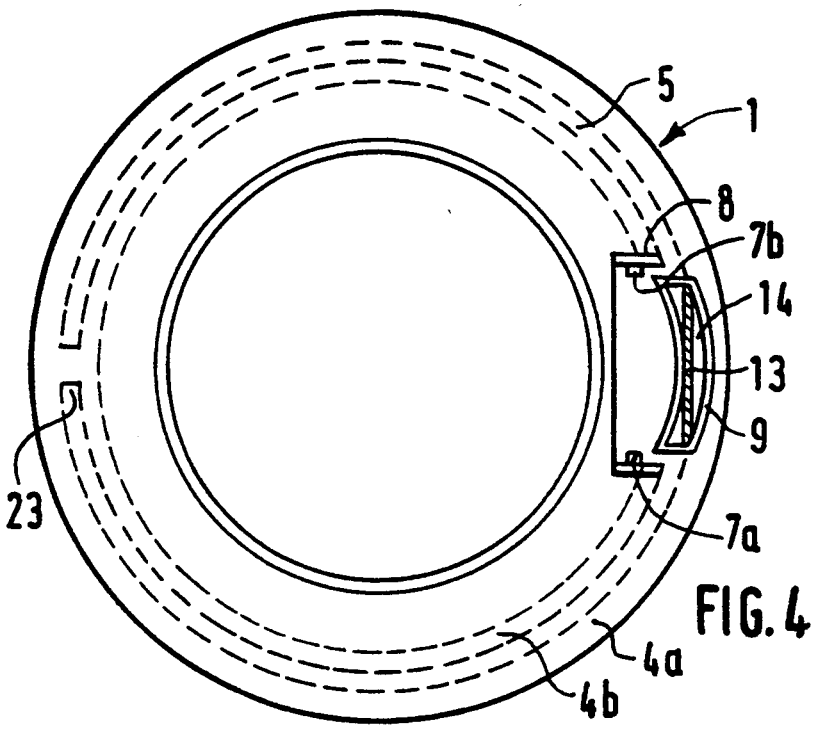
FIG. 4
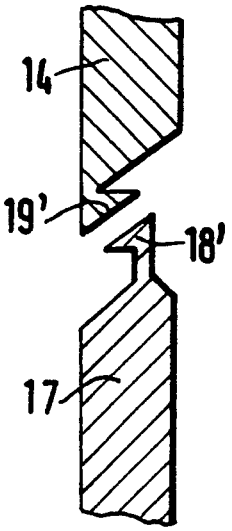
FIG. 5

PACKAGING DEVICE FOR COSMETIC PRODUCTS

BACKGROUND OF THE INVENTION

The present invention relates to packaging devices in particular for cosmetic products, that have a controlled-opening lid.

Packaging devices for cosmetic products, makeup in particular, are generally made of a body such as a box or pot containing the product, fitted with a lid.

Certain known devices have a screw-on lid; however, once removed from the body, the lid is a voluminous part that is inconvenient to handle.

Other known devices include a lid articulated to the body and held in the open position by an elastic element which can be compressed when the lid is closed. A closure is then provided on the device to hold the lid in the closed position.

However, these devices have the drawback that, when the closure is unlocked, the lid snaps open, which can be unpleasant for the user and damage the user's image of the packed product. In addition, the rapid swinging up of the lid can cause the product to splash out.

To slow down such a lid as it opens, one design makes the lid integral with a damping mechanism, but this design is expensive and pointlessly increases the volume of the packaging device which is generally small in size.

SUMMARY OF THE INVENTION

A goal of the present invention is to overcome the disadvantages mentioned above by offering a packaging device having a lid whose opening is continuously controllable, and which device is also simple and economical to make.

The subject of the present invention is a packaging device, particularly for cosmetics, having a pot-shaped body and a lid articulated thereto. The packaging device also includes an operating element rotatably mounted on the body and having an inclined ramp. The lid has, in the vicinity of its articulation to the body, a tongue which engages a vertical guide (or recess) provided in the wall of the body. The tongue is integral in vertical translation with the upper surface of the inclined ramp of the operating element such that a rotational movement of the operating element relative to the body and to the tongue causes a guided translational movement of the tongue in the wall of the body, and tilting of the lid around its articulation axis on the body.

BRIEF DESCRIPTION OF THE DRAWINGS

For better understanding of the invention, an embodiment provided as a nonlimiting example will now be described with reference to the attached drawings in which like reference numerals refer to like elements and wherein:

FIG. 3 is a sectional view through the FIG. 1 embodiment of the device where the lid has been tilted into the open position;

FIG. 4 is a top view of the body of the device in a section along plane IV—IV in FIG. 3; and FIG. 5 is another embodiment in accordance with the invention of the attachment assembly between the tongue of the lid and the inclined ramp of the operating element.

DETAILED DESCRIPTION OF PREFERRED EMBODIMENTS

According to one preferred embodiment of the invention, the operating element is a cylindrical wheel which has a sloping ramp, or wall, the height of which decreases from one end to the other of the ramp. The wall extends over at least part of the circumference of the wheel, preferably over substantially half thereof. That is, the ramp is curved and extends over at least a segment of an annular portion of the cylindrical wheel.

When the operating element is rotated, the device according to the invention can maneuver the lid continuously, with the opening angle of the lid being determined by the rotational angle of the operating element.

Advantageously, the slope of the ramp of the operating element is such that when the operating element is turned at a measured rate corresponding to normal manipulation of the device, the lid is opened gradually and flexibly.

In one embodiment of the invention, the operating element has a bottom wall which forms the bottom of the device. The device is then manipulated in a manner similar to, for example, a lipstick tube with the body being blocked from rotating (for example, by being held by a user), and the lower part of the device being rotated.

Advantageously, the body may have a double side wall which accommodates the ramp of the operating element. This both allows the ramp to be hidden inside the device and the inside cavity of the body (intended to receive the packed product) to be isolated from the ramp.

Various types of assemblies can be used to join the tongue of the lid to the ramp of the operating element.

The device as generally described above is shown in FIGS. 1–5. The device has a body I of cylindrical shape made of plastic for example, a lid 2 also made of plastic for example, and a wheel 3 which in accordance with the invention is the lid operating element.

Figure 1:
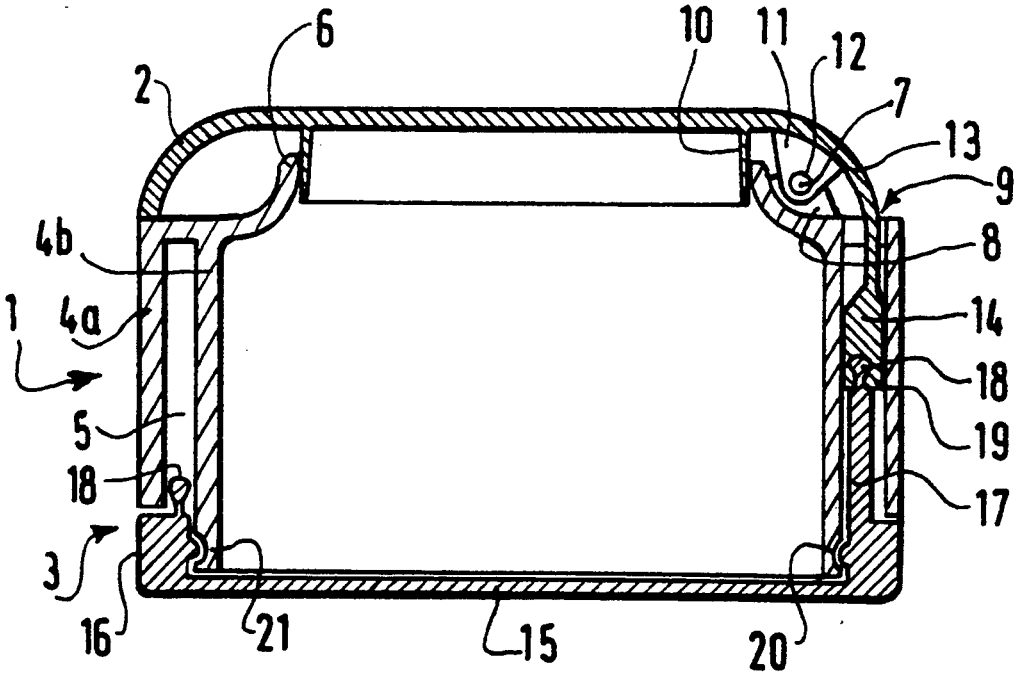
FIG. 1 is a sectional view through one embodiment of the device in accordance with the invention.

In FIG. 1, body 1 of the device described has a double side wall formed by an outer wall **4*a* and an inner wall 4*b*, with an annular cavity 5 open at the bottom. At its upper part, body 1 includes a neck 6** having a smaller diameter than the lower portions.

In FIG. 1, the lower end of body 1 is open. Alternatively, it is possible to provide body with a closed bottom, in the shape of an operculum, or a rigid wall joined to inner wall **4*b*** by, for example, heat treatment, gluing or molding.

The articulation of lid 2 to body I is provided around an axis 7 defined by pins **7*a* and 7*b* provided on tabs 8 formed on the body at the level of neck 6**.

In the vicinity of this articulation zone, the body has a recess (or slide) 9. Recess 9 is provided in walls **4*a* and 4*b* of the body and in annular cavity 5, and extends slightly further radially than annular cavity 5. Recess 9 is designed to receive the tongue 13 of lid 2 to ensure guided vertical sliding thereof. Recess 9 also prevents tongue 13 from moving laterally when wheel 3** is rotated.

Lid 2, circular in plan view, has a central skirt 10 which is located in the closed position around the inner cavity of body 1, inside neck 6, to ensure that the packaging cavity is sealed in the closed position. Two tabs 11, each including an orifice 12, are articulated onto tabs 8 of lid 1 around axis 7. In the vicinity of its articulation, lid 2 is extended by flexible tongue 13. Flexible tongue 13 ends with an end part 14 whose cross section is essentially of the same size as recess 9 provided in walls 4*a* and 4*b* of body 1. Advantageously, lid 2 and its tongue 13 are made as a single part, by injection molding for example. End part 14 is designed to slide in a vertical direction inside recess 9 so as to exert a lever action on lid 2, causing lid 2 to tilt. For a lever action to be exerted on lid 2, tongue 13 should be maintained distant from articulation axis 7 of lid 2. Tabs 11 maintain this relationship.

The translation of tongue 13 inside recess 9 takes place under the influence of the rotation of wheel 3. As can be seen more clearly in FIG. 2, wheel 3 is cylindrical in shape and has a bottom 15 and a side wall 16. Side wall 16 is the gripping surface of wheel 3 once mounted on body 1, with outer wall 4*a* of body 1 being shorter than its inner wall 4*b*.

Near its periphery and over substantially half of its circumference, wheel 3 has a wall in the shape of a sloping ramp 17 provided with a rib 18, in a dovetail shape. Rib 18 of sloping ramp 17 cooperates with end part 14 of lid 2, which has a recess 19 of corresponding shape with rib 18 and in which rib 18 of wheel 3 can slide. This joint of the dovetail type allows ramp 17 to slide in the circumferential direction relative to tongue 13. The joint also ensures that ramp 17 and tongue 13 are joined in the vertical translation direction. Once mounted on end part 14 of lid 2, sloping ramp 17 is accommodated in annular cavity 5 of body 1.

In the illustrated embodiment, wheel 3 is snapped onto body 1 by an annular rib 20 which engages an annular groove 21 provided in the lower part of inner wall 4*b* of body 1.

In another embodiment, not shown, bottom 15 of wheel 3 may have a skirt surrounding inner wall 4*b* on the inside, whereby the height of the skirt may correspond to the height of inner wall 4*b*. Thus, together with bottom 15 of the wheel, the skirt defines a container for the packed product.

FIG. 4 is a top view of body 1 and tongue 13 of lid 2 in a section along plane IV–IV in FIG. 3. Double side wall 4*a*, 4*b* is shown in dashed lines in this figure. Articulation axis 7 of the lid is defined by two pins 7*a* and 7b which are engaged by orifices 12 in tabs 11 of lid 2.

FIG. 4 shows that the cross section of recess 9 of body 1 is slightly greater than the cross section of end part 14 of lid 2 so that, as wheel 3 rotates, end part 14 is held in recess 9 and can move only in a vertical translational direction.

A stop 23 is provided in cavity 5, opposite to recess 9. This stop 23 is designed to limit the rotation of wheel 3 so that wheel 3 is rotated without the link between end part 14 and rib 18 of ramp 17 being broken.

In the illustrated embodiment, ramp 17 extends over essentially half the circumference of the wheel. A single stop 23 suffices to limit the rotation of the wheel. It is also possible to provide two stops, or for ramp 17 to extend over a lesser or greater amount of the circumference of the wheel.

Operation of the device will now be described. The device is in the closed position as shown in FIG. 1. In the closed position, ramp 17 of wheel 3 pushes back tongue 13 of lid 2 by presenting its upper end at right angles to the guide recess 9 provided on body 1. The height of ramp 17 is chosen such that tongue 13 exerts a slight pressure on the lid in the closed position.

Figure 2:
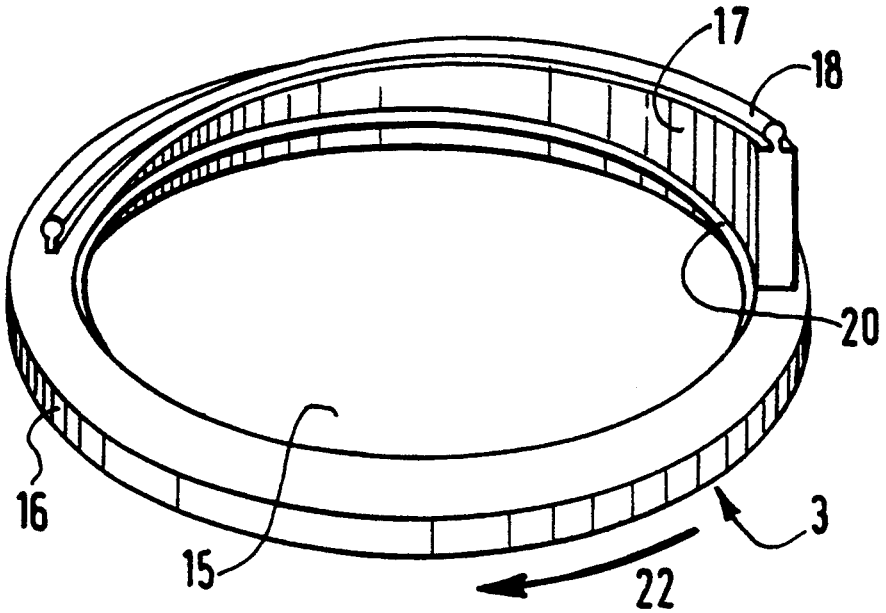
FIG. 2 is a perspective view of the operating element of FIG. 1.

To open the device, a rotational torque is applied to wheel 3 in the direction represented by arrow 22 in FIG. 2. Movement of ramp 17 at right angles to recess 9 brings about downward translation of tongue 13. Because of tabs 11, tongue 13 exerts a lever action on lid 2, which will bring it into the open position shown in FIG. 3. A progressive tilting movement of lid 2 is achieved by continuous rotation of wheel 3. The height of the lower end of ramp 17 is chosen such that lid 2 is tilted to a maximum angle in its open position.

In an embodiment shown in FIG. 5, tongue 13 of lid 2 and inclined ramp-shaped part 17 of wheel 3 have at their respective ends bent shapes 18′ and 19′ which cooperate to hook tongue 13 to ramp-shaped part 17 of wheel 3.

The embodiments described are not limiting in nature and may receive any desirable modifications without thereby departing from the scope of the invention. For example, the wheel may have a sloping ramp over its entire periphery, in which case the body will have no stop to lock the wheel rotationally.

What is claimed is:

1. A packaging device for cosmetic products, comprising:

a body having a wall and defining a chamber;

a lid pivotally attached to said body at an articulation area;

an operating element rotatably mounted on said body and having an inclined ramp; and a tongue attaching said lid to said ramp, and located near said articulation area, said tongue engaging a vertical guide provided in said wall, whereby said tongue moves vertically along with an upper surface of said ramp located adjacent to said vertical guide when said operating element is rotated relative to said body so that said rotation of said operating element causes a guided movement of said tongue in said vertical guide of said body and tilting of said lid around said articulation area.

2. The device according to claim 1, wherein said operating element is a cylindrical wheel having said ramp located on a periphery of said wheel, said ramp having a height which decreases from a first end of said ramp to a second end of said ramp, said ramp extending over at least a portion of a circumference of said wheel.

3. The device according to claim 1, wherein said operating element includes a bottom wall which forms a bottom of said chamber.

4. The device according to claim 1, wherein said body includes a double side wall, said ramp being accommodated within said double side wall.

5. The device according to claim 1, further comprising means for snap-fitting said operating element to said body.

6. The device according to claim 1, further comprising a dovetail assembly slidably joining said ramp to said tongue, said dovetail assembly permitting said ramp to slide in a circumferential direction relative to said tongue and ensuring linkage between said ramp and said tongue during movement in a vertical translational direction.

7. The device according to claim 1, wherein said tongue and said ramp include bent portions which cooperate to hook said tongue to said ramp.

8. The device according to claim 1, wherein said tongue and said lid are of one-piece plastic construction.

9. The device according to claim 1, wherein a lower portion of said body is open.

10. The device according to claim 9, wherein said operating element defines a bottom of a container for holding a packed product.

11. A packaging device for cosmetic products, comprising:

a body having a wall, first and second opposite ends, and defining a chamber;

a lid pivotally attached to said first end of said body;

an operating element rotatably mounted on said second end of said body and having an inclined ramp; and a tongue attached between said lid and said ramp, said tongue being slidably attached to said ramp so that rotation of said operating element, relative to said body, causes said ramp to slide relative to said tongue, causing said tongue to move along a longitudinal axis of said tongue and said lid to pivot on said body.

12. The device according to claim 11, wherein said tongue is attached to said lid adjacent to a portion of said lid which is pivotally attached to said body.

13. The device according to claim 11, wherein said operating element rotates in a plane perpendicular to an axis of said body extending between said first and second ends of said body.

14. The device according to claim 11, further comprising a recess formed in said wall of said body, said tongue being slidably received in said recess, said recess permitting said tongue to slide along said longitudinal axis of said tongue when said operating element is rotated while limiting movement of said tongue in a direction perpendicular to said longitudinal axis.

15. The device according to claim 11, wherein said operating element includes a plate, said ramp located on a peripheral portion of said plate and having a height which decreases from a first end of said ramp to a second end of said ramp.

16. The device according to claim 15, wherein a central portion of said plate defines a bottom of said chamber.

17. The device according to claim 11, further comprising a dovetail assembly slidably joining said ramp to said tongue.

18. The device according to claim 11, wherein said tongue and said lid are unitary.

19. The device according to claim 11, wherein said second end of said body is open.

20. A packaging device for cosmetic products, comprising:

a body having an outer cylindrical wall, first and second opposite ends, and defining a chamber;

a lid pivotally attached to said first end of said body;

an operating element rotatably mounted on said second end of said body and having an inclined ramp, said inclined ramp having a height which increases from a first end of said ramp to a second end of said ramp, said ramp being curved and located radially within said outer cylindrical wall; and a tongue attached between said lid and said ramp, said tongue being slidably attached to said ramp so that rotation of said operating element, relative to said body, causes said ramp to slide relative to said tongue, causing said tongue to move along a longitudinal axis of said tongue and said lid to pivot on said body.

21. The device according to claim 20, wherein said body includes an inner cylindrical wall attached to said outer cylindrical wall and located radially within said outer cylindrical wall, said ramp located between said inner and outer cylindrical walls.

22. The device according to claim 20, wherein said second end of said body is open, and said operating element includes a plate, said ramp located on a peripheral portion of said plate, a central portion of said plate defining a bottom of said chamber.

* * * * *